US005394060A

United States Patent [19]

Yoon

[11] Patent Number: 5,394,060

[45] Date of Patent: Feb. 28, 1995

[54] INCLINED GETTER STRUCTURE FOR A MAGNETRON

[75] Inventor: Yong G. Yoon, Seoul, Rep. of Korea

[73] Assignee: Goldstar Co., Ltd., Seoul, Rep. of Korea

[21] Appl. No.: 988,527

[22] Filed: Dec. 10, 1992

[30] Foreign Application Priority Data

Dec. 17, 1991 [KR] Rep. of Korea ..... 91-22620

[51] Int. Cl.[6] ..... H01J 23/05; H01J 25/50

[52] U.S. Cl. ..... 315/39.51; 313/106; 313/558; 313/345

[58] Field of Search ..... 315/39.51, 39.63, 39.67; 313/341, 344, 345, 558, 560, 561, 106

[56] References Cited

U.S. PATENT DOCUMENTS

| | | | |
|---|---|---|---|
| 3,988,636 | 10/1976 | Sato et al. | 315/39.51 |
| 4,132,921 | 1/1979 | Hatayama et al. | 315/39.53 X |
| 4,733,124 | 3/1988 | Oguro et al. | 315/39.67 X |

FOREIGN PATENT DOCUMENTS

| | | | |
|---|---|---|---|
| 17354 | 1/1989 | Japan | 315/39.51 |
| 41143 | 2/1989 | Japan | 315/39.63 |
| 4147539 | 5/1992 | Japan | 315/39.51 |

*Primary Examiner*—Benny T. Lee
*Attorney, Agent, or Firm*—Morgan & Finnegan

[57] ABSTRACT

This invention relates to a magnetron for generating a microwave, in which an upper end shield and a lower end shield for supporting respectively top end and bottom end of a filament, which is a cathode portion, are included, the upper end shield being made in a flange shape having a flat portion of a diameter bigger than an outer diameter of the filament, and a getter for absorbing a generating gas within a vacuum bulb body is mounted on top surface of the upper end shield, and the getter includes a flat portion mounted to the flat portion of the upper end shield and an inclined portion extended downwardly from the end edge of the flat portion so that the electrons generated from the cathode collides and is absorbed.

5 Claims, 3 Drawing Sheets

INCLINED GETTER STRUCTURE FOR A MAGNETRON

FIELD OF THE INVENTION

The present invention relates to a magnetron, and more particularly to a getter structure of magnetron which is made to improve an oscillating efficiency by improving both forms of a upper end shield for supporting a top end of a filament and a getter mounted on the top surface of the shield.

BACKGROUND OF THE INVENTION

Generally, the magnetron for generation of a high frequency energy is a kind of diode vacuum tube, as shown in FIG. 1, in which a serial type cathode (hereinafter called as "filament") 4 having a cathode portion axially provided at its center and an anode 1 provided around its circumference.

On the other hand, an upper yoke 6*a* and a lower yoke 6*b* are provided for applying a magnetic flux between the filament 4 and an anode 1, and a magnetic circuit is formed which is provided in turn with magnet 7 and magnetic pole 8 respectively to the top and bottom surfaces of each yoke 6*a*,6*b*, and an antenna 9 for discharging the high frequency energy transmitted from the anode 1 to exterior (cavity), an antenna seal 10, an antenna ceramic 11 and an antenna cap 12 are provided.

And, heat radiating plate 3 for radiating the heat generated by the collision of thermions (thermally charged electrons) at the anode vane 1*a* is provided, and a choke coil 13 for blocking that unnecessary high frequency component generated at the operating space 5 and high voltage capacitor 14 are made so as to be protected by a filter box 15.

Accordingly, the above-described magnetron executes cycloidal motion by receiving forces of electric field in which thermions emitted from the filament 4 are applied between the anode vane 1*a* and the filament 4 and the magnetic flux applied to an operating space 5 by magnetic pole 8 on the magnetic circuit, and according to this the thermion experienced acceleration becomes to generate the high frequency energy, therefore the anode vane 1*a* receives this energy.

A magnetron disclosed in Japanese laid open Utility Model publication official gazette No. Sho-52-109439 is a form as shown in FIG. 2, which comprises a filament 4 made of coil shape which emits thermions, a upper end shield 16 for supporting a top end of the filament 4, a lower end shield 17 for supporting a bottom end of the filament 4, a side lead 19 for supporting the lower end shield 17 and conducting the filament 4, a center lead 18 for supporting the upper end shield 16 and conducting the filament 4, and a getter 24 fixed by welding on top surface of the upper end shield 16.

Aforementioned filament 4 is made of usually thorium-tungsten, the getter 24 is made of zirconium, and the end shields 16,17 are made of high melting point metal of molybdenum.

On the other hand, a spacer 20 for preventing a vibration is provided at the middle of the both leads 18,19, and the ends of both leads are supported at an insulating ceramic 21 so as to be connected with filament terminals 22, respectively.

And, a seal 23 is adhered for making these to a vacuum bulb body, and the getter 24 at the top of the upper end shield 16 is for absorbing a generating gas of the vacuum bulb body.

Accordingly, when a power is supplied to the filament, a voltage is applied through the both end shields 16,17 to the filament 4, and the filament 4 is heated to high temperature and a large quantity of thermions 25 are emitted from the surface of the filament 4 as shown in FIG. 3, which is attracted toward the anode vane 1*a* having a positive (+) potential as shown by arrows so as to generate an oscillation by a mutual operation with magnetic field.

On the other hand, in order to prevent a separation of the thermions along an axial direction, a downwardly extended bent portion 16*b* is formed at both ends of flat portion 16*a* of the upper end shield 16.

However, in such conventional magnetron, the thermions emitted from the top end, e.g., a neighboring portion of the upper end shield 16 can not be attracted to the entire anode portion, and collide to the internal surface of the bent portion 16*b* formed at the upper end shield 16 and thereafter reflected and come out, and accordingly secondary electrons a,b by the colliding energy becomes generated. Therefore, movement of the thermions are scattered by a disturbance of the electric field pattern, and it is impossible for 100% of the thermions emitted from the filament 4 to flow to the anode portion. Accordingly, the thermions contributing or causing the oscillation become decreased and an oscillation efficiency of the magnetron has been reduced.

Since a material of the upper shield is molybdenum which does not have good plasticity or elasticity characteristics, the upper end shield is of a complicated form requiring much expense and time in manufacture.

SUMMARY OF THE INVENTION

Accordingly, it is an object of the present invention to provide a getter and an upper end shield form of magnetron for preventing an electric disturbance of an operating space within the magnetron by secondary electrons generated from the upper end shield of the magnetron.

Another object of the present invention is to provide a getter and a simple form of upper end shield of the magnetron so as to be able to simplify the manufacturing process of the magnetron and decrease and save manufacturing cost.

Here, the invention is structured such that the upper end shield is formed with a flange shape having a flat portion of bigger diameter than an outer diameter of the filament, and the getter is formed so as to have a flat portion corresponding to the flat portion of the upper end shield and an inclinded portion extended downwardly from the end edge of the flat portion so that the electrons emitted from the cathode collide in the direction of the getter and are then absorbed.

The novel features which are considered as characteristic for the invention are set forth in particular in the appended claims. The invention itself, however, both as to its structure and method, together with additional objects and advantages thereof, will be best understood from the following description of specific embodiment when read in connection with the accompanying drawings.

BRIEF DESCRIPTION OF THE DRAWINGS

For a better understanding of the invention, and to show how the same may be carried into effect, reference will now be made, by way of example, with respect to the accompanying drawings, in which.

Throughout the drawings, like reference numerals and symbols are used for designating like or equivalent parts or portions, for simplicity of illustration and explanation.

DETAILED DESCRIPTION OF THE INVENTION

Figure 1:
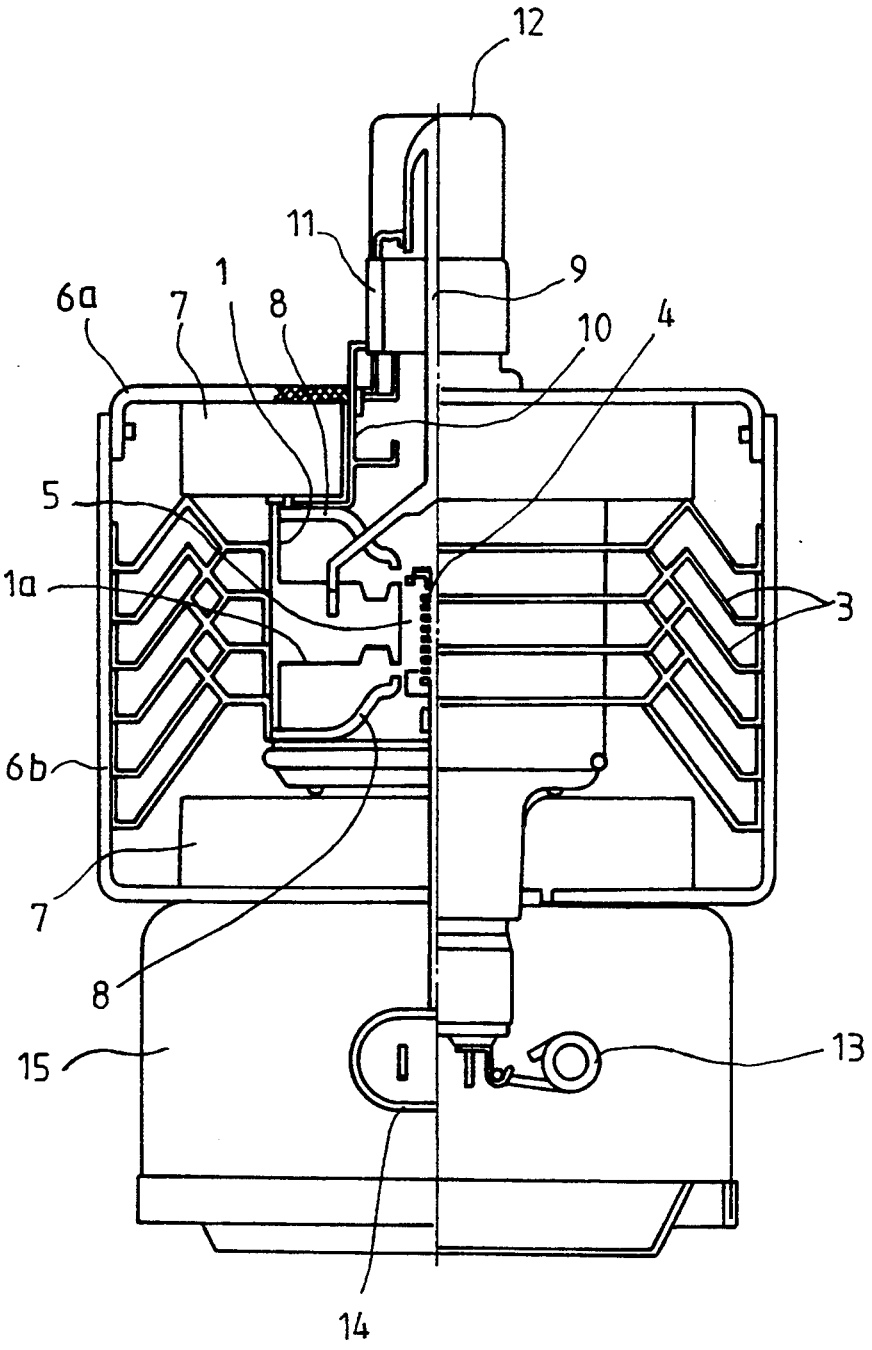
FIG. 1 PRIOR ART
FIG. 1 is a front half cross sectional view showing a structure of general magnetron.
Figure 2:
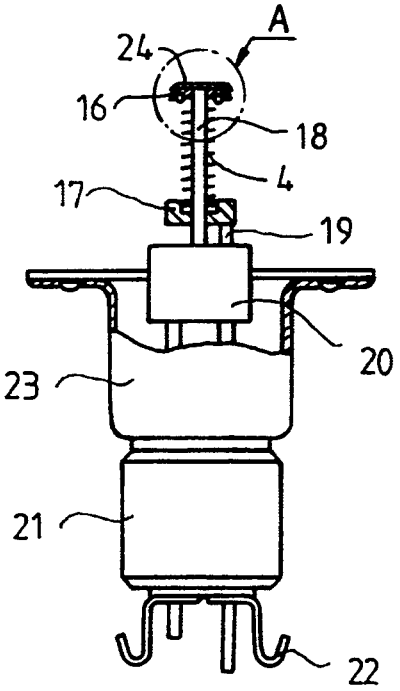
FIG. 2 PRIOR ART
FIG. 2 is a front view showing a cathode structure of a conventional magnetron which is partly cut out.
Figure 3:
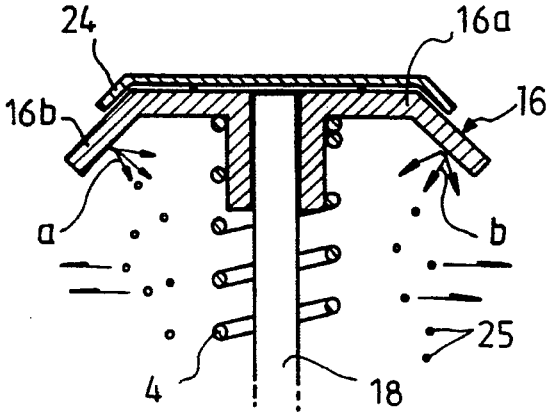
FIG. 3 PRIOR ART
FIG. 3 is a fragmentary magnified cross sectional view of "A" portion of FIG. 2.
Figure 4:
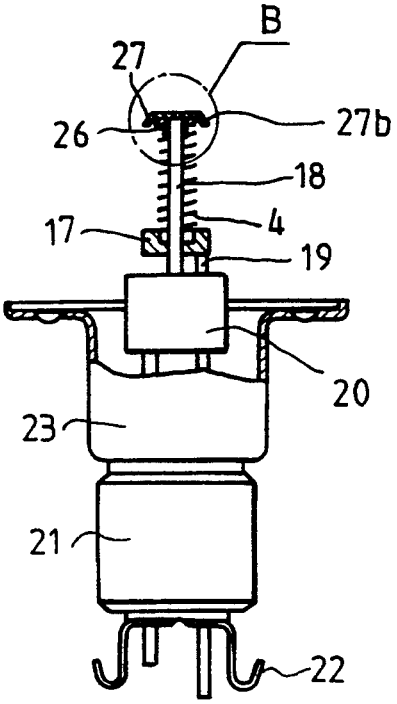
FIG. 4 is a front view showing a getter structure of a magnetron of the present invention.
Figure 5:
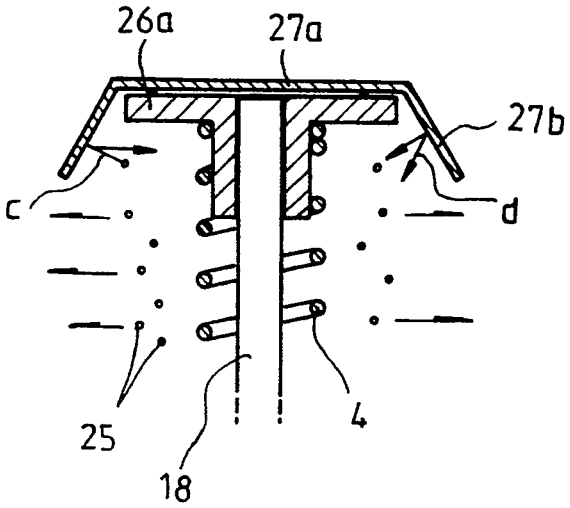
FIG. 5 is a fragmentary magnified cross sectional view of "B" portion of FIG. 4.

FIG. 4 and FIG. 5 show a structure of the magnetron in accordance with the present invention, and wherein as seen in FIG. 4 a upper end shield 26 and a lower end shield 17 made of molybdenum material for supporting the filament 4 are respectively provided at the top end and the bottom end of the filament 4 of thorium-tungsten material made of a coil shape which emits the thermions. The upper end shield 26 is made in to "T" shape, e.g., flange shape and includes a flat portion 26*a* of bigger diameter than the outer diameter of the filament 4 (see FIG. 5).

On the other hand, a center lead 18 and a side lead 19 for applying a power to the filament 4 are respectively connected mechanically and electrically to the upper and lower end shields 27,17.

And, a spacer 20 for preventing the vibration is provided at the middle of the both leads 18,19, and the both leads 18,19 are supported by an insulating ceramic 21 and connected to the filament terminals 22.

And, a seal 23 for sealing these via a vacuum bulb body is provided at the exterior of the spacer 20. A getter 27 for absorbing a generating gas within the vacuum bulb body is provided, and at this moment, the getter 27 includes a flat portion 27*a* (see FIG. 5) mounted on the top surface of the upper end shield 26 and an inclined portion 27*b* downwardly extended from the end edge of the flat portion 27*a* so as to form an umbrella shape. The getter 27 is made of zirconium which is a metal material and simultaneously a material that secondary electron emitting coefficient is lower than the upper end shield 26, e.g., a work function is bigger.

Explaining the operation and effect of the present invention constructed as these, it will be as follows.

Accompanying drawings FIG. 5 is a fragmentary magnified view of "B" portion of FIG. 4, and as like as the conventional cathode portion, when a power is supplied to the filament terminals 22, the filament 4 is heated to a high temperature and a number of thermions (thermally charged electrons) 25 are emitted from the surface of the filament 4, and which is attracted toward the anode vane, e.g., anode portion as shown by arrow direction so as to generate an oscillation.

Thus, when the thermions emitted from the filament 4 are attracted to the anode portion formed in radial shape around the filament, the thermions emitted from a neighboring portion of the upper end shield 26 collide to the inner surface of the inclined portion 27*b* formed at the getter 27 and is reflected and thereby secondary electrons c,d are produced, however at this time, in the present invention, since the getter 27 is made by a zirconium which is a metal material being low in the secondary electron emitting coefficient, it is possible to suppress in maximum that the secondary electrons are produced.

As described above, in accordance with the present invention, since it becomes possible to suppress in maximum that the secondary electrons are produced when the thermions are emitted from the filament 4 toward the anode portion by a structural change in which the upper end shield 26 for supporting the filament 4 is made of a flange shape of "T" shape, and the getter 27 fixed to the top portion of the upper end shield is made in an umbrella shape having an inclined portion 27*b* and its material is made of zirconium, an efficiency of the magnetron can be improved.

On the other hand, the shape of the upper end shield 26 which does not have good plasticity or elasticity characteristics is simplified, therefore it can have an effect that a manufacturing cost can be reduced by a time curtailment of a molding operation.

While the invention has been illustrated and described as embodied in a magnetron for generating a microwave, it is not intended to be limited to the details shown, because various modifications and structural changes may be made without departing in any way from the spirit of the present invention.

It will be understood that each of the elements described above, or two or more together, may also find a useful application in other types of constructions differing from the types described above.

Without further analysis, the foregoing will so fully reveal the gist of the present invention that others can, by applying current knowledge, readily adopt it for various applications without omitting features that, from the standing point of prior art, fairly constitute essential characteristics of the generic or specific aspects of this invention.

What is claimed is:

1. Magnetron for generating a microwave comprising:

a) a cathode portion structured by a serial type filament for generating electrons;

b) an anode portion spaced from and surrounding said cathode portion, wherein an electric field is applied between said cathode and anode portions for accelerating said electrons therebetween;

c) a magnetic circuit portion for generating a magnetic field having an orientation which is perpendicular to an orientation of the electric field;

d) upper and lower end shields for supporting said cathode portion, wherein said upper end shield is in the shape of a flange having a flat portion; and e) a getter disposed on said upper end shield having a getter flat portion with first and second end edges corresponding to peripheral edges of the flat portion of said upper end shield and inclined portions extending angularly and in a downward direction from the first and second end edges of the getter flat portion, wherein the inclined portions of said getter extend beyond the peripheral edges of the flat portion of said upper end shield.

2. Magnetron for generating microwave as defined in claim 1, wherein said getter comprises a first material having a first electron emitting coefficient, wherein said upper end shield comprises a second material having a second electron emitting coefficient, and wherein the first electron emitting coefficient is substantially smaller than the second electron emitting coefficient.

3. Magnetron for generating microwave as defined in claim 1, wherein said getter comprises zirconium.

4. A getter-end shield combination supporting a cathode, said getter-end shield combination comprising:

an upper end shield having a "T" shape cross-sectional area and having an upper flat portion with first and second shield edges; and a getter disposed on the upper flat portion of said upper end shield, said getter having a getter flat portion with first and second end edges respectively corresponding to the first and second shield edges of the upper flat portion of said upper end shield, and said getter having inclined portions extending diagonally downward from the first and second end edges of the getter flat portion defining an acute angle with respect to the upper flat portion of said upper end shield.

5. A getter-end shield combination as defined in claim 4, wherein said getter comprises a first material having a first electron emitting coefficient, wherein said upper end shield comprises a second material having a second electron emitting coefficient, and wherein the first electron emitting coefficient is substantially smaller than the second electron emitting coefficient.

* * * * *